US005383328A

United States Patent [19]

Brown

[11] Patent Number: 5,383,328

[45] Date of Patent: Jan. 24, 1995

[54] SADDLE TREE ASSEMBLY HAVING MULTIPLE PROGRESSIVELY LOADED ADJUSTMENTS

[75] Inventor: Roy L. Brown, Nevada, Mo.

[73] Assignee: Ortho-Flex Saddle Co., Inc., Nevada, Mo.

[21] Appl. No.: 87,788

[22] PCT Filed: Aug. 15, 1991

[86] PCT No.: PCT/US91/05786

§ 371 Date: Aug. 26, 1993

§ 102(e) Date: Aug. 26, 1993

[87] PCT Pub. No.: WO92/12094

PCT Pub. Date: Jul. 23, 1992

[51] Int. Cl.[6] ..... B68C 1/04

[52] U.S. Cl. ..... 54/44.3

[58] Field of Search ..... 54/42.1, 44.1, 44.3, 54/44.7

[56] References Cited

U.S. PATENT DOCUMENTS 15,744 9/1856 Plant ..... 54/44.3

FOREIGN PATENT DOCUMENTS 84008 11/1895 Germany ..... 54/44.1

3902305 8/1990 Germany ..... 54/44.3

4517 of 1896 United Kingdom ..... 54/44.7

*Primary Examiner*—Robert P. Swiatek

*Attorney, Agent, or Firm*—Hovey, Williams, Timmons & Collins

[57] ABSTRACT

An improved saddle tree assembly (10) which permits infinite adjustment at multiple points so that the tree may be selectively adjusted to accommodate the physical characteristics of a given horse. The saddle tree assembly includes a pair of laterally spaced apart, flexible synthetic resin skirts (12, 14) together with a spanning, overlying tree frame (16). The frame is coupled to the skirts by means of threaded adjustment structures (18, 20, 22, 24) permitting selective shifting between the tree frame and skirts. At each connection point between the tree frame and skirts, a multiple-layer, rivet-connected plate assembly (62, 64 and 82, 84) is provided, which serves to effectively and evenly distribute the rider's weight, in order to minimize pinching or bruising of the horse's back. The skirts may be provided with slots (110) to permit the skirts to more readily conform to the horse's back and permit relative translational movement of the skirts relative to the tree frame to follow the movement of the horse's back.

14 Claims, 3 Drawing Sheets

Fig. 5.
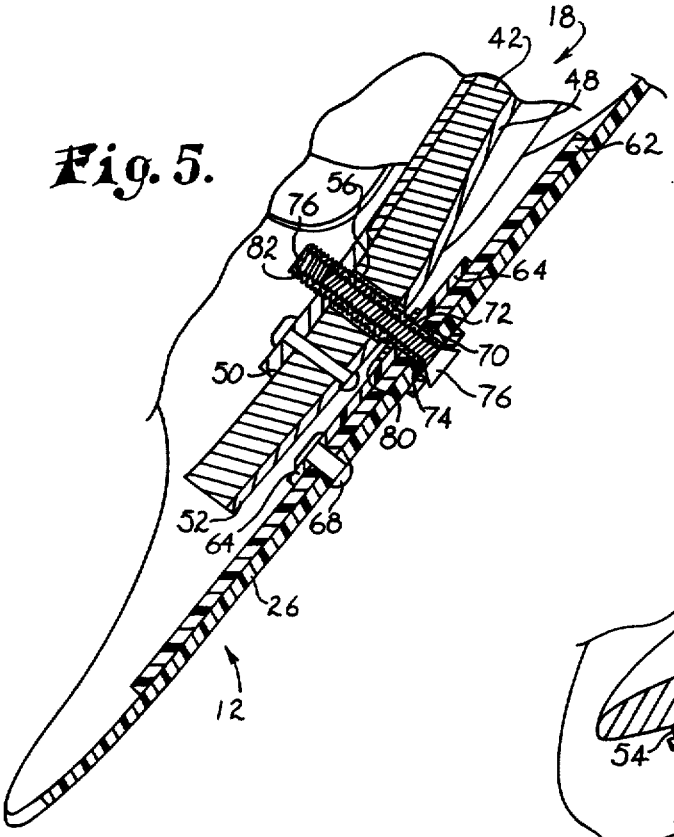
Fig. 6.
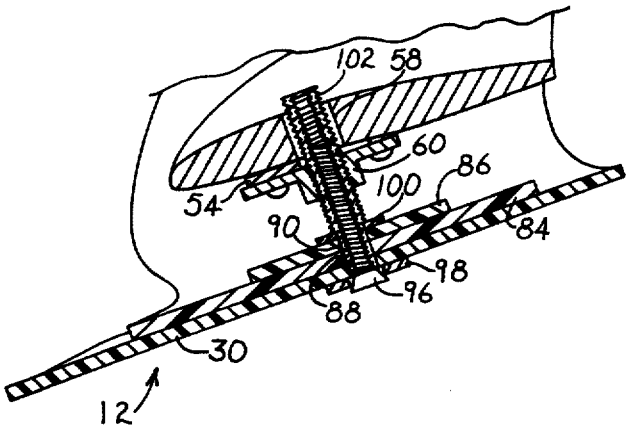
Fig. 7.
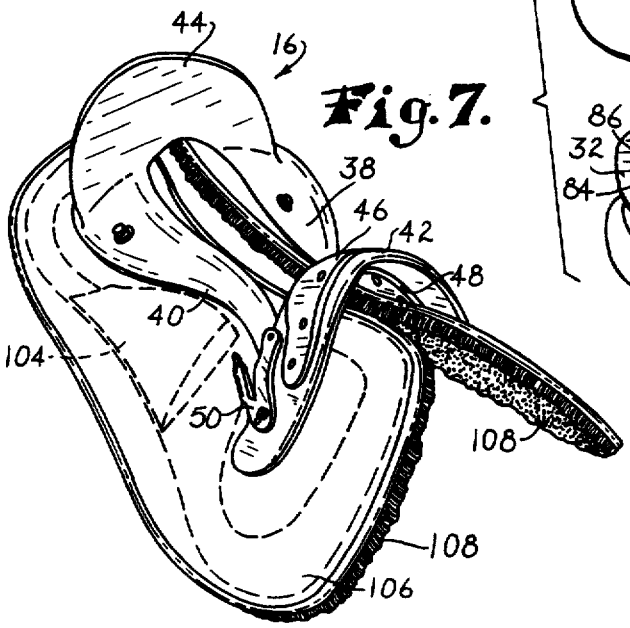
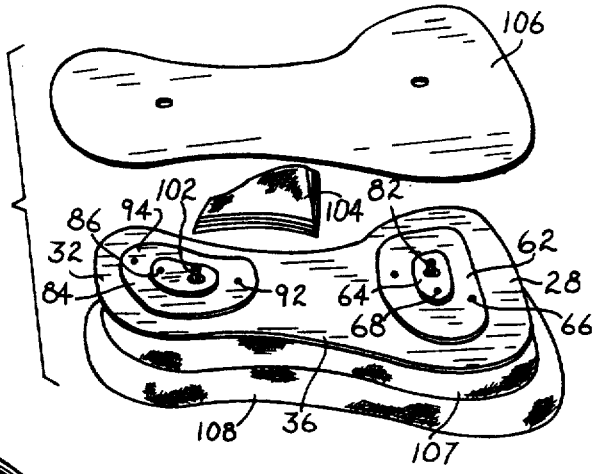
Fig. 8.

Fig. 11.
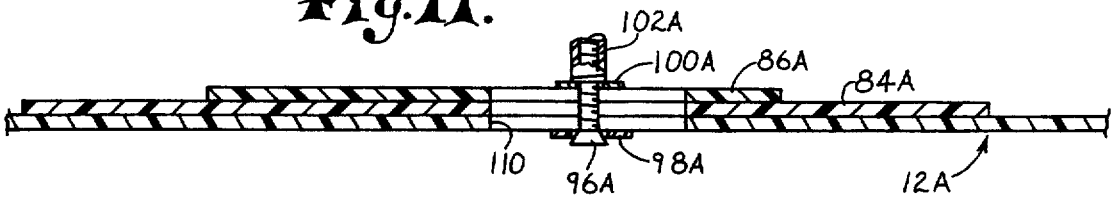
Fig. 10.
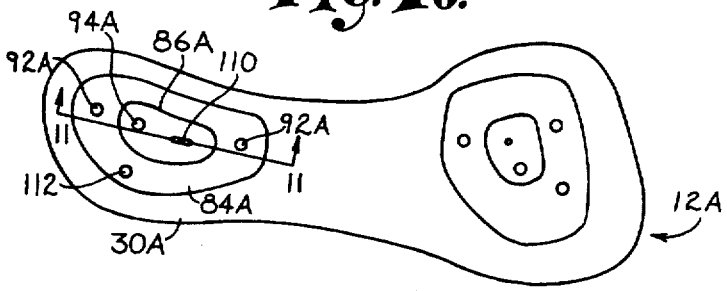
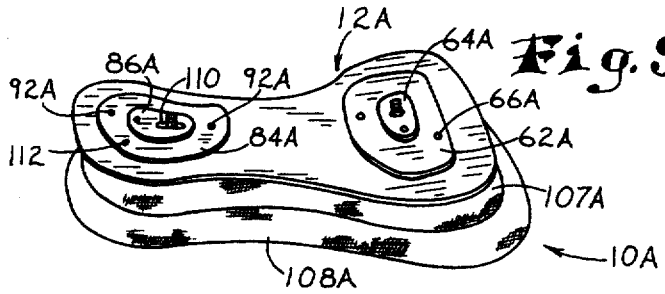
Fig. 9.

SADDLE TREE ASSEMBLY HAVING MULTIPLE PROGRESSIVELY LOADED ADJUSTMENTS

BACKGROUND OF THE INVENTION

1. Field of the Invention

The present invention is broadly concerned with an improved saddle tree assembly which is adjustable front to rear and side to side so as to accommodate the particular physical characteristics of a given horse. More particularly, it is concerned with such a tree assembly comprising a pair of laterally spaced apart, flexible synthetic resin skirts, together with an overlying saddle tree frame; threaded adjustment structure is used to interconnect the skirts and frame, permitting selective shifting of at least certain portions of the frame toward and away from the underlying skirts. The assembly of the invention is also improved by provision of plural, layered, progressively smaller mounting plates secured to the fore and aft ends of the skirts in such a manner as to permit limited spring-like flexure of the skirts and mounting plates.

2. Description of the Prior Art

A major problem in saddling is the tendency of many horses to slope downwardly from rear to front. This "downhill" conformation causes the weight of the rider to be concentrated over the wither shoulder area of the horse, particularly if the saddle sits too low in front. Since weight cannot be carried by the horse on this arched shoulder area without pinching, it is necessary to shift the weight being borne to a more rearward portion of the saddle. The traditional approach to this problem is to move the saddle forward up onto the shoulders, thereby raising the front of the saddle; however, this expedient often gives disastrous results to the physiology and mechanics of the horse. Another attempted solution to this problem is to add padding under the saddle, but this in turn can create a very unstable saddling condition by inducing side to side roll of saddle and rider.

Another related problem results from the fact that a very high percentage of horses are "one-sided" right or left. Without expert training to overcome this inherent characteristic, a horse may develop a visible difference in the size of his shoulders and an aberration in gait. Finally, horses ridden extensively at square trot often develop a condition wherein the left front shoulder is over developed, while the right rear, working in conjunction with the left front leg, will also be larger and over developed.

As an example of the foregoing difficulties, consider a horse thin in the wither and shoulder area and having a downhill conformation. Further, assume that a horse is much stronger and more developed on his left shoulder than on his right, with a corresponding over developed right rear. It will be readily appreciated that saddling of such a horse using conventional saddles will be very difficult. Thus, while in theory it is understood that a saddle should be ride-balanced both front to rear and side to side, accomplishing this goal with many horses can be a daunting task.

U.S. Pat. No. 4,745,734 represents a significant breakthrough in the art in that it provides a flexible saddle which distributes the combined weight of saddle and rider over a large surface area on a horse's back, thereby minimizing bruising and soreing of the horse. However, the saddle described in this patent does not provide multiple points of adjustment permitting the saddle to be "custom tailored" to a particular horse. U.S. Pat. No. 4,745,734 is incorporated by reference herein.

SUMMARY OF THE INVENTION

The present invention overcomes the problems described above and provides a greatly improved saddle tree assembly having adjustment structure permitting variation in saddle height and orientation both front to rear and side to side. In addition, the tree of the invention includes a multiple-layer, spring panel assembly at the connection points between the tree frame and underlying skirts, whereby the weight of the rider is spread outward 360° from each adjustable mounting point on the tree frame assembly.

In more detail, the saddle tree assembly of the invention includes a pair of laterally spaced apart skirts preferably formed of flexible synthetic resin material (e.g., Delrin) adapted to overlie a horse's back, together with a tree frame in overlying, spanning relationship to the skirts. Means is provided for operably coupling the frame to the skirts, including adjustment structure for selective shifting of at least certain portions of the tree frame toward and away from at least one of the skirts, in order to thereby adjust the tree frame to accommodate the physical characteristics of a specific horse.

In practice, the frame is secured to the underlying skirts at four points, namely the fore and aft ends of each skirt. To this end, at each such securement point, an adjustable connection assembly is provided. Each such connection assembly includes a pair of synthetic resin (Delrin) mounting plates of progressively smaller surface area stacked one atop the other to present an inner mounting plate and an outboard mounting plate. These plates are secured to the underlying skirt end by means of a pair of spaced apart rivets extending through each skirt end and the proximal plate, and a single rivet passing through the skirt end, the proximal plate, and the outboard mounting plate.

Adjustability is provided by means of an elongated screw passing through one of the frame and skirts at each connection assembly point and being rotatable relative thereto but fixed against axial movement. An elongated, annular, internally and externally threaded connector is secured to the other of the frame and skirts and receives the screw, with the screw and connector being fixed against relative movement. Preferably, the adjustment screws pass through the skirt ends and associated mounting plates, whereas the threaded connector is threaded into appropriate metallic plates provided on the tree frame. In any event, rotation of the screws effects corresponding rotation of the connectors and consequent relative movement between the tree frame and underlying skirts. In this fashion, the tree frame can be adjusted independently at four spaced apart points, thereby permitting the frame to be properly fitted to each individual horse.

In particularly preferred forms of the invention, slots are provided in the skirts and rear mounting plates for receiving the elongated screw therethrough. The screw is thus able to move longitudinally along the slot, thereby permitting greater flexibility for the panels to flex and conform to the horse during movement of the horse, or to conform more readily to the anatomy of a particular horse.

BRIEF DESCRIPTION OF THE DRAWINGS

FIG. 5 is an enlarged, fragmentary sectional view illustrating one of the forward connections between an underlying skirt and the tree frame forming the overall saddle tree assembly;

FIG. 6 is a view similar to that of FIG. 5, but depicting a rearward connection with the frame shifted relative to the skirt for adjustment purposes;

FIG. 7 is a fragmentary exploded view illustrating the components of one completed skirt;

FIG. 8 is a perspective view illustrating a completed saddle tree assembly equipped with leather covering and an underlying fleece-like material.

FIG. 9 is a perspective view similar to FIG. 7 of an alternative embodiment of the present invention showing a slot located in the rear mounting panels;

FIG. 10 is a plan view of the right side panel of the embodiment of FIG. 9; and

FIG. 11 is an enlarged fragmentary cross-sectional view taken along line 10—10 illustrating the screw extending through the slot provided in the rearward end of the skirt and corresponding mounting panels.

DESCRIPTION OF THE PREFERRED EMBODIMENT

Figure 2:
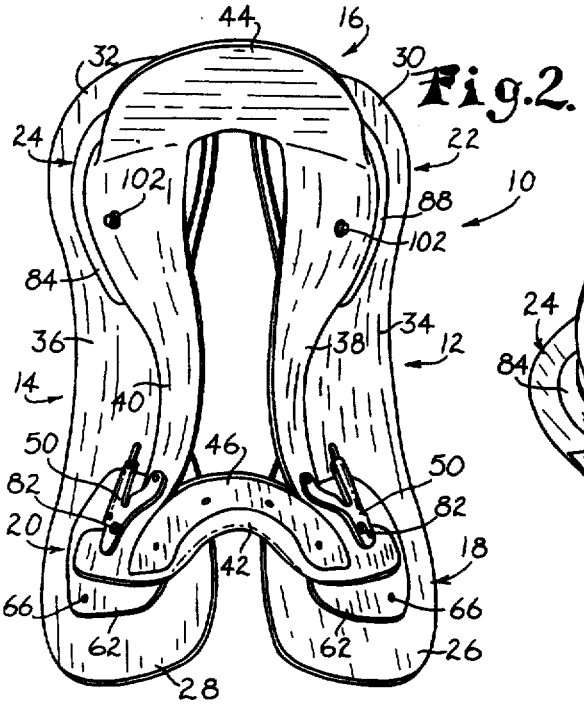
FIG. 2 is a plan view thereof.
Figure 1:
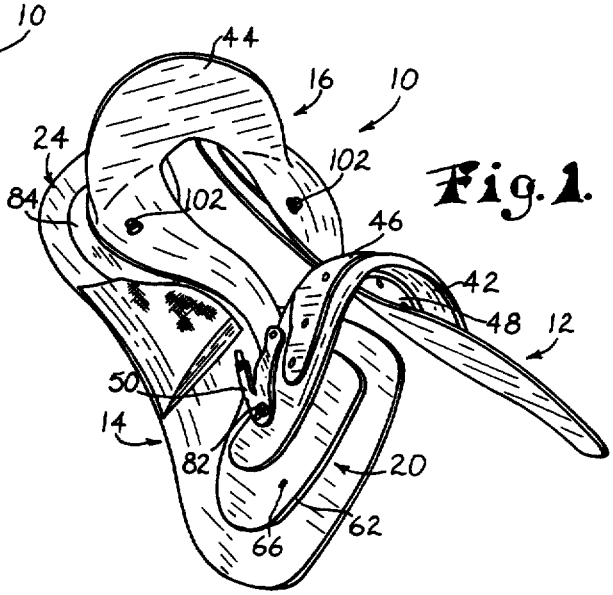
FIG. 1 is a perspective view of the saddle tree assembly in accordance with the invention.
Figure 3:
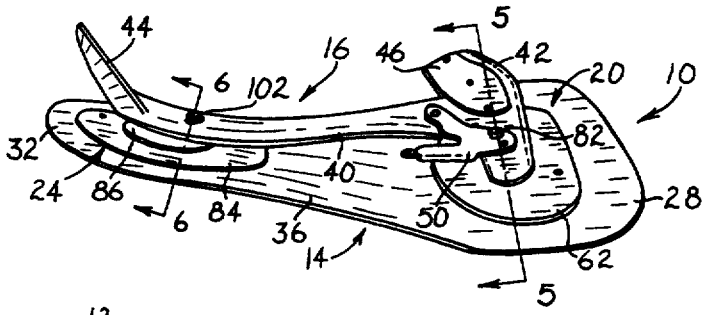
FIG. 3 is a side view thereof.
Figure 4:
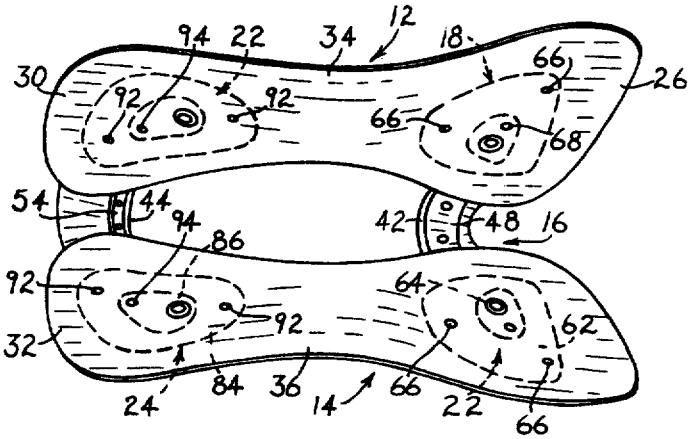
FIG. 4 is a bottom view thereof, with the locations and sizes of the stacked mounting plates being illustrated in phantom.

Turning now to the drawings, the saddle tree assembly 10 is illustrated in FIGS. 1-4. Broadly speaking, the assembly 10 includes a pair of elongated, flexible synthetic resin skins 12, 14 adapted to overlie a horse's back, an elongated tree frame 16 in overlying, spanning relationship to the skirts 12, 14, and a total of four adjustable, load-bearing securement assemblies 18-24 respectively located adjacent the fore and aft ends of the skirts 12, 14, and sewing to couple the frame 16 to the skirts.

In more detail, each of the skirts 12, 14 is essentially a mirror image of the other and presents a forward end 26, 28, a rearward end 30. 32, and a central body 34, 36. As illustrated in FIGS. 1-4, the skirts 12, 14 are somewhat bowed at their respective central regions, and are moreover twisted fore to aft, all in the manner to those well skilled in the art for the purpose of generally conforming the skirts to a horse's back. As indicated earlier, these skirts are advantageously formed of ⅛" to 1/10" thick Delrin which may be tapered to a feather edge along the lower margin of each central body 34, 36. Finally, each of the skirts 12, 14, is appropriately apertured at the forward and rearward ends thereof for connection of the respective securement assemblies 18-24 as will be described.

Tree frame 16 includes arcuate side bars 38, 40 as well as interconnecting pommel 42 and cantle 44. The described frame members may be formed of hardwood or a synthetic resin composite. It will be observed that pommel 42 is also equipped with metallic bracing 46, 48, as well as upper and lower metallic fixtures 50, 52 (see FIG. 5); and that cantle 44 has an underlying metallic reinforcing strip 54. An aperture 56 is provided through each of the opposed forward ends of the pommel 42, as well as through the fixtures 50, 52; the openings through the fixtures 50 are threaded for purposes to be made clear. In addition, an aperture 58 is provided through the rearmost section of each sidebar 38, 40. An annular, threaded coupling boss 60 is affixed to the underside of the sidebars 38, 40 in registry with the openings 58.

Each of the securement assemblies 18-24 includes a pair of stacked, superposed, apertured mounting plates positioned at the fore and aft ends of the skirts 12, 14. Referring first to FIG. 5, it will be seen that each forward end securement assembly includes the first mounting plate 62 in face to face relationship with the forward end 26 or 28 of the corresponding skirt, as well as a second outboard mounting plate 64 atop the plate 62. It will be seen in this respect that the plate 62 has a surface area smaller than that of the corresponding skirt forward end, and that the plate 64 has a smaller surface area than the plate 62. The plates 62, 64 are mounted for limited flexure on the associated skirt. To this end, the larger first mounting plates 62 are connected by means of a pair of spaced rivets 66 extending through the skirt and first plate. The second plate on the other hand is secured by means of a single rivet 68 extending through the skirt, first plate 62 and second plate 64. It will also be seen that the plates 62, 64 have respective aligned openings 70, 72 therethrough, which register with a similar opening 74 in the underlying skirt.

Again referring to FIG. 5, it will be seen that the forward securement assemblies will include an elongated threaded screw 76 which extends through the openings 70-74 and is restrained against axial movement by means of a washer 78 and retaining ring 80. An elongated, annular, internally and externally threaded connector 82 receives the shank of screw 76 and is also threaded into the threaded opening provided through the fixture 50. As illustrated, the inboard end of the connector 82 abuts ring 80. Moreover, the screw 76 and connector 82 are fixed to prevent relative movement there between, such as through the use of Loctite or other expedient.

The rearward securement assemblies 22, 24 are very similar to the forward assemblies described above. Specifically, and referring to FIG. 6, each of the rearward assemblies includes stacked first and second mounting plates 84, 86 of progressively smaller surface area. The plates 84, 86 have registered openings 88, 90 therethrough which are in alignment with the similar opening through the associated skin rearward end. The mounting plates are affixed to the skirt by means of rivet pair 92 used to connect the larger plate 84, and a single rivet 94 extending through the associated skirt and both of the mounting plates. An elongated, threaded screw 96, held against axial movement by means of washer 98 and retaining ring 100, is received by and passes through the skirt and mounting plate apertures. An elongated, internally and externally threaded connector 102 receives the shank of screw 96 and abuts ring 100. It will be seen that the connector 102 is threadably received by a corresponding boss 60. Again, the screws 96 and connectors 102 are fixed against relative movement.

In the alternate embodiment of the assembly 10A shown in FIGS. 9, 10 and 11, the skin 12A is shown in a slightly modified version. Panel 12A (and correspondingly a similar panel not shown) is provided with a generally fore and aft extending slot 110 in the rearward end 30A thereof, and which extends through mounting plates 84A and 6A. That is to say, panel 12A and mounting plates 84A and 86A define therein elongated slot 110 which is of a width sufficient to receive screw 96A therethrough and is provided with a longitudinal length of about one inch or about 2.5 centimeters. The mounting plates 84A and 86A are aligned with panel 12A so that the slot 110 is in registry as shown in FIG. 11. Assembly 10A is also provided with rivet 112 connecting the mounting plate 84A to the panel 12A in addition to rivet pair 92A and single rivet 94A previously described. Other components provided with an "A" suffix shown in FIGS. 9, 10 and 11 for the alternate embodiment 10A correspond to the similarly numbered components of FIGS. 7 through 8, and is in all other respects similar to the assembly 10 shown therein.

In the fabrication of a complete saddle tree assembly, the respective skins 12, 14 are fabricated using the above-described components (see FIG. 7). In order to finish the assembly, however, a matte-type thigh pad 104 is placed on the central body 34, 36 of each skirt 12, 14, whereupon a leather cover 106 is adhesively applied over each skirt. This cover extends downwardly beyond the lower margin of each skirt as best seen in FIG. 8. In addition, a cushioning pad 107 and a fleece-like liner 108 are applied to the underside of each skirt and are secured to cover 106. Appropriate apertures (not shown) are provided through the pads 107 and liners 108 in order to permit adjustment of the saddle tree assembly by allowing access to the screws 76 and 96. Once the skirts 12, 14 have been completed, tree frame 16 may be attached, simply by threading the respective connectors 82, 102 into the threaded hardware associated with each of the tree frame apertures 56 and 58. The girth rigging, fenders and stirrup assemblies may then be attached to the saddle tree assembly in the conventional fashion to give a complete saddle.

In the use of the saddle tree assembly of the invention, adjustments can be simply made in order to accommodate the particular physical characteristics of a given horse. Thus, fore and aft and side to side adjustments can be readily made, simply through rotation of the adjustment screws 76, 96. As will be readily understood from a study of FIGS. 5 and 6, rotation of each of the screws in a clockwise direction will cause the associated portion of the tree frame to move closer to the underlying skirt. Likewise, counterclockwise rotation of the screws causes the adjacent section of the tree frame to move away from the underlying skirt. In this manner, infinite adjustments at four separate points can be provided.

The use of multi-layered, spring-like mounting plates also gives significant advantages. First, this design serves to spread the weight or a rider outwardly through a full 360° from each adjustment position on the corners of the saddle tree assembly. Therefore, the rider's weight is transferred to the horse via four adjustable points. This effect is enhanced by virtue of the fact that mounting plates are only riveted to the skirts, and not adhesively secured. Thus, each of the mounting plates may flex and give as necessary, and thereby more effectively spread the rider's weight to minimize pinching or undue weight concentrations at particular points on a horse's back.

The alternate embodiment 10A provides some additional advantages for conforming to the back of a horse. The screw 96A is able to shift longitudinally within slot 110, thereby enabling the panel 12A and mounting plates 84A and 86A to slide relative to tree frame 16 and to flatten at the center if the horse raises his back. The slot 110 defines the length of the travel and thus the range though which panel 12A and mounting plates 84A and 86A may move translationally fore and aft relative to tree frame 16. The slot 110 also allows the panel 12A to bend downward responsive to pressure exerted on the tree frame 16 by the stirrup straps and riders thighs and to thereby conform to the hollowing of the horse's back. Thus the panel 12A and mounting plates 84A and 86A riveted thereto are able to follow a range of movement of an individual horse's back, in addition to permitting the saddle to fit a wide range of basic horse's shapes.

I claim:

1. A saddle tree assembly comprising:

a pair of laterally spaced apart flexible skirts adapted to overlie a horse's back;

a tree frame supported by said skins and positioned in overlying, spanning relationship thereon; and means operably coupling said frame to said skirts, including adjustment structure for selectively shifting at least certain portions of said tree frame toward and away from at least one of said skirts, in order to adjust said tree frame to accommodate the physical characteristics of a specific horse, said adjustment structure comprising a threaded fastener operably coupling said tree frame to said skirts and including an elongated screw passing through one of said frame and skirts and being rotatable relative thereto but fixed against axial movement, an elongated, annular, internally and externally threaded connector, and means for threadably securing the other of said frame and skirts to the connector for receiving said screw, said screw and connector being fixed against relative movement, whereby rotation of said screw will effect corresponding rotation of said connector and consequent movement of the frame or skirts.

2. The saddle tree assembly of claim 1, said skirts being formed of resilient, flexible synthetic resin material.

3. The saddle tree assembly of claim 1, said screw passing through said skirt, and said connector being threadably secured to said frame.

4. The saddle tree assembly of claim 3, including there being a pair of annular retainers on opposite faces of said skirt and receiving said screw, said threaded connector abutting one of said retainers positioned adjacent said frame.

5. A saddle tree assembly comprising:

a pair of laterally spaced apart flexible skirts adapted to overlie a horse's back;

a tree frame supported by said skirts and positioned in overlying, spanning relationship thereon; and means operably coupling said frame to said skirts, including adjustment structure for selectively shifting at least certain portions of said tree frame toward and away from at least one of said skirts, in order to adjust said tree frame to accommodate the physical characteristics of a specific horse.

each of said skins presenting, adjacent the fore and aft ends thereof a mounting plate of lesser surface area than the corresponding skirt end, there being means for securing each of the said mounting plates to a respective skirt end for permitting limited flexure of the mounting plate relative to the skin end, said securing means including at least one securement member for fastening said mounting plate to a corresponding one of said skirt ends in face-to-face relationship with a substantial portion of the opposing surfaces of said mounting plate and said skin end being free of connection for permitting limited spring-like flexure of the skirts and said mounting plates, said skirts and said mounting plates being formed of resilient, flexible synthetic resin material, said tree frame being secured to said skirts at the regions of said mounting plates.

6. The saddle tree assembly of claim 5, said adjustment structure serving to secure said tree to said skins.

7. A saddle tree assembly comprising:

a pair of laterally spaced apart skins adapted to overlie a horse's back, each of said skins presenting fore and aft ends;

a tree frame supported by said skins and positioned in overlying, spanning relationship thereon; and means operably coupling said frame to said skirts, including, adjacent the fore and aft ends of each of said skins, a pair of mounting plates stacked one atop the other and each of progressively smaller surface area to present an inner mounting plate and an outboard mounting plate, there being means for securing each of the mounting plate pairs to a respective skirt end for permitting limited, progressive flexure of each of the mounting plates relative to the skirt end and each other, said tree frame being secured to said skirts at the regions of said mounting plates, said mounting plates being formed of resilient, flexible synthetic resin material, said mounting plate pairs being positioned intermediate said tree frame and a respective skirt.

8. The saddle tree assembly of claim 7, said securement means comprising a pair of spaced apart rivets extending through said mounting plates and corresponding skirt end.

9. The saddle tree assembly of claim 7, said securement means comprising a pair of spaced apart rivets extending through each corresponding skirt end and the inner mounting plate, and a single rivet passing through said skirt, the inner mounting plate, and the outboard mounting plate.

10. A saddle tree assembly comprising:

a pair of laterally spaced apart skirts for engaging a horse's back;

a tree frame oriented above and supported by said skirts in overlying, spanning relationship thereto; and means operatively coupling said frame to said skirts for permitting independent translational movement of said skirts along and relative to said tree frame and for conforming the skirts to the horse's back during movement of the horse, said coupling means including structure for transferring the weight borne by said tree frame to said skirts for spreading of such weight by said skirts engaging the horse's back.

11. A saddle tree assembly as set forth inclaim 10, wherein each of said skins is provided with structure defining at least one elongated slot therein, and said coupling means includes a member extending through said at least one slot and attached to said tree frame.

12. A saddle tree assembly as set forth inclaim 11, wherein each said skins include respective fore and aft ends and present, adjacent the fore and aft ends thereof, a mounting plate of lesser surface area than the corresponding skirt end, said slot extending through each said mounting plate and receiving said member therethrough.

13. A saddle tree assembly as set forth inclaim 12, wherein said at least one slot is oriented generally fore and aft for providing limited fore and aft translational movement between said tree frame and said skirts.

14. A saddle tree assembly as set forth inclaim 12, wherein said member is an elongated screw, and said coupling means further comprises an elongated, annular, internally threaded connector threadably connected to said screw whereby rotation of said screw will effect movement of at least one of said skirts toward or away from said frame.

* * * * *

UNITED STATES PATENT AND TRADEMARK OFFICE

CERTIFICATE OF CORRECTION

PATENT NO. : 5,383,328

DATED : January 24, 1995

INVENTOR(S) : Roy L. Brown

It is certified that error appears in the above-indentified patent and that said Letters Patent is hereby corrected as shown below:

In column 6, line 15, delete the word "skins" and insert -- skirts --.

In column 6, line 58, after the word "horse", delete "." and insert -- , --.

In column 6, line 59, delete the word "skins" and insert -- skirts --.

In column 6, line 64, delete the word "skin" and insert -- skirt --.

In column 7, line 2, delete the word "skin" and insert -- skirt --.

In column 7, lines 9, 11, 12, 14 and 18, delete the word "skins" and insert -- skirts --.

In column 8, lines 19 and 24, delete the word "skins" and insert -- skirts --.

Signed and Sealed this

Twenty-first Day of November, 1995

*Attest:*

Bruce Lehman

BRUCE LEHMAN

*Attesting Officer*

*Commissioner of Patents and Trademarks*